US009835974B2

(12) United States Patent
Montag

(10) Patent No.: US 9,835,974 B2
(45) Date of Patent: Dec. 5, 2017

(54) METHOD AND DEVELOPER STATION FOR ADAPTATION OF THE INKING OF AN IMAGE SUBSTRATE OF A TONER-BASED DIGITAL PRINTER

(71) Applicant: Oce Printing Systems GmbH & Co. KG, Poing (DE)

(72) Inventor: Thomas Montag, Unterhaching (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 15/159,941

(22) Filed: May 20, 2016

(65) Prior Publication Data

US 2016/0342108 A1 Nov. 24, 2016

(30) Foreign Application Priority Data

May 20, 2015 (DE) ..... 10 2015 107 938

(51) Int. Cl.

| | |
|---|---|
| ***G03G 15/06*** | (2006.01) |
| ***G03G 15/10*** | (2006.01) |
| ***G03G 15/11*** | (2006.01) |
| ***G03G 15/00*** | (2006.01) |

(52) U.S. Cl.

CPC ..... *G03G 15/065* (2013.01); *G03G 15/105* (2013.01); *G03G 15/11* (2013.01); *G03G 15/55* (2013.01)

(58) Field of Classification Search

CPC ..... G03G 15/065; G03G 15/105; G03G 15/11
See application file for complete search history.

(56) References Cited

U.S. PATENT DOCUMENTS

| | | | | |
|---|---|---|---|---|
| 7,664,437 | B2 * | 2/2010 | Kellie | G03G 15/065 399/237 |
| 9,031,426 | B2 | 5/2015 | Zollner et al. | |
| 2003/0175049 | A1 | 9/2003 | Ichida et al. | |
| 2003/0185596 | A1 * | 10/2003 | Kellie | G03G 15/065 399/240 |
| 2005/0169671 | A1 * | 8/2005 | Kellie | G03G 15/101 399/237 |
| 2010/0296825 | A1 * | 11/2010 | Kella | G03G 15/105 399/31 |
| 2014/0212632 | A1 | 7/2014 | Bayer et al. | |

(Continued)

FOREIGN PATENT DOCUMENTS

| | | | |
|---|---|---|---|
| DE | 102012103336 | A1 | 10/2013 |
| DE | 102013201549 | B3 | 6/2014 |
| JP | 2014149526 | A | 8/2014 |

*Primary Examiner* — Carla Therrien
(74) *Attorney, Agent, or Firm* — Schiff Hardin LLP

(57) ABSTRACT

A method and a developer station are described. The method and developer station being operable to adapt the inking of an image substrate. The method including applying a voltage across a developer layer on the developer element of the developer station. The application of the voltage causing a current to flow through the developer layer, where the current can be measured. The an indicator of a thickness of the developer layer and/or of the toner quantity in the developer layer is generated based on the voltage and/or the current. The indicator can be used to adjust the inking of the image substrate. For example, the current can be compared to a characteristic curve to generate the indicator.

18 Claims, 5 Drawing Sheets

(56) References Cited

U.S. PATENT DOCUMENTS

2014/0348526 A1* 11/2014 Lopez ..... G03G 15/105
399/57
2015/0071665 A1* 3/2015 Lam ..... G03G 15/0851
399/60

* cited by examiner

METHOD AND DEVELOPER STATION FOR ADAPTATION OF THE INKING OF AN IMAGE SUBSTRATE OF A TONER-BASED DIGITAL PRINTER

CROSS REFERENCE TO RELATED APPLICATIONS

This patent application claims priority to German Patent Application No. 102015107938.0, filed May 20, 2015, which is incorporated herein by reference in its entirety.

BACKGROUND

The disclosure is directed to a toner-based digital printer (e.g., electrographic digital printer) configured to print to a recording medium with toner.

Given toner-based digital printers, for example, a latent charge image (given an electrographic printer) or a latent magnetic image (given a magnetographic printer) of an image substrate is inked with toner (for example liquid toner or dry toner). The toner image that is thus created is transferred directly from the image substrate or indirectly via a transfer station onto a recording medium. Even given the transfer of a plurality of identical toner images (i.e. given the creation of a plurality of identical print images), the inking or the color location of the different print images should thereby be kept constant in order to provide a uniformly high print quality.

A uniform inking of different print images requires a uniform inking of a toner image. In this context, DE102012103336A1 describes a method via which the concentration of toner particles in a liquid developer may be determined and adapted. It may thus be ensured that liquid toner with a defined quantity of toner particles is used in an electrophotographic digital printer.

However, the use of liquid toner with a defined quantity of toner particles typically still does not guarantee a uniform inking of toner images. In particular, a change to the inking of the toner image may occur via a change to the quantity of liquid toner which is provided by a developer station for inking of the toner image.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 4A:
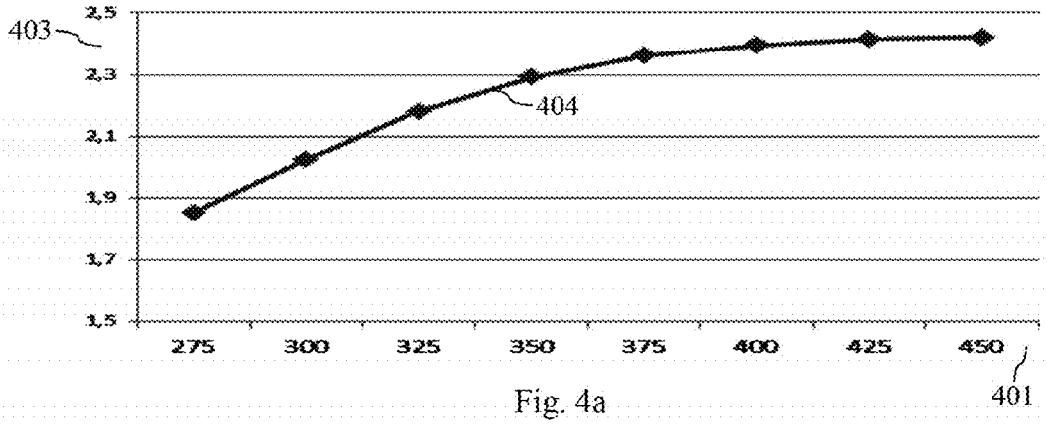
Figure 4B:
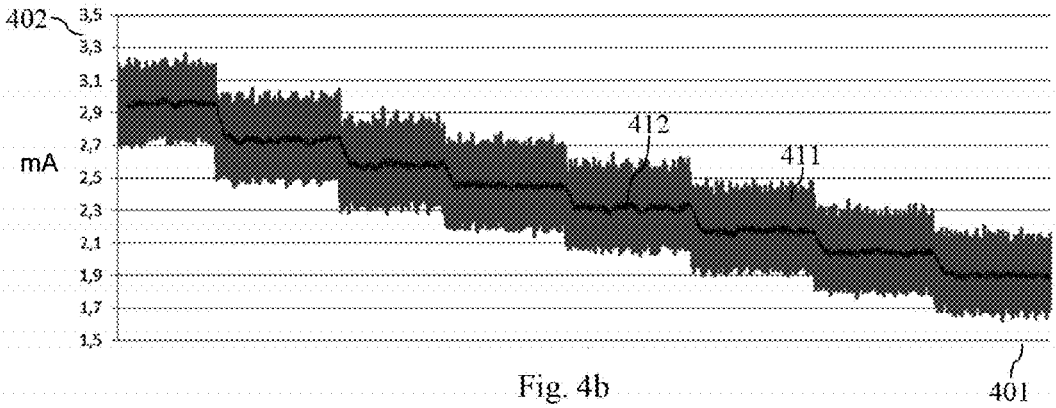
Figure 4C:
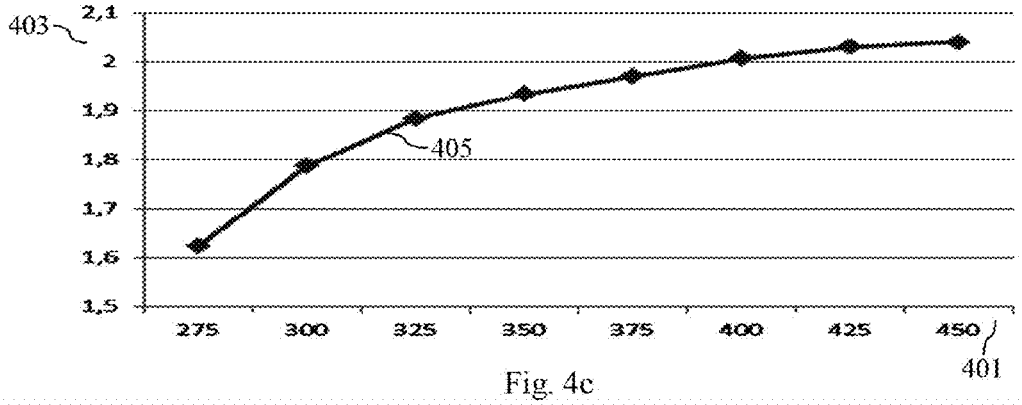
Figure 4D:
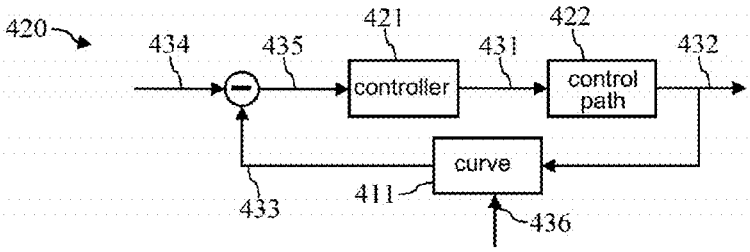
Figure 5:
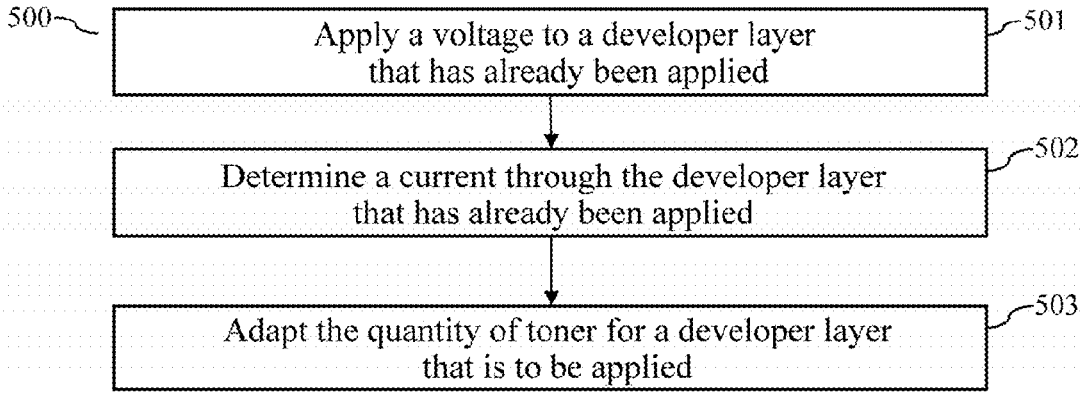

FIG. 4*a* illustrates a curve of an optical measurement signal with regard to the inking of a developer roller according to an exemplary embodiment of the present disclosure;

FIG. 4*b* illustrates a curve of the current through a developer layer on a developer roller according to an exemplary embodiment of the present disclosure;

FIG. 4*c* illustrates a curve of an optical measurement signal with regard to the inking of a recording medium according to an exemplary embodiment of the present disclosure;

FIG. 4*d* illustrates a control loop configured to adjust the thickness of a developer layer according to an exemplary embodiment of the present disclosure; and FIG. 5 illustrates a workflow diagram of a method for the adaptation of a developer layer in a developer station according to an exemplary embodiment of the present disclosure.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide a method and a corresponding developer station via which a defined quantity of toner or of toner particles is precisely provided in order to ensure a uniform inking of toner images.

According to one aspect, a method is described for the adaptation of a developer layer on a developer element, wherein the developer element is set up to ink an image substrate of a toner-based digital printer with toner particles from the developer layer. The developer layer may also comprise a carrier fluid (a mineral oil, for example) in addition to toner particles. The developer layer may thus comprise a liquid developer. The method can include the application of a voltage between a measurement electrode and the developer element, wherein the measurement electrode is arranged such that a developer layer that has already been adapted for the inking of the image substrate is located between the measurement electrode and the developer element. The method can additionally include the determination (the detection, for example) of a current that flows between the measurement electrode and the developer element due to the voltage. Moreover, the method includes the adaptation of a developer layer (which is to be adapted for the inking of the image substrate) depending on the voltage and/or depending on the current.

According to a further aspect, a developer station for a print group of a toner-based digital printer is described. The developer station comprises a developer element that is set up to ink an image substrate of the print group with toner particles from a developer layer. The developer station additionally comprises a doser that is set up to apply a developer layer onto the developer element and/or to adapt a developer layer for the inking of the image substrate. Moreover, the developer station comprises a measurement electrode that is arranged such that a developer layer that has already been applied by the doser onto the developer element and/or that has already been adapted by the doser for the inking of the image substrate is located between the measurement electrode and the developer element. The developer station additionally comprises a voltage source that is set up to apply a voltage between the measurement electrode and the developer element. Furthermore, the developer station comprises a current measurement device that is set up to determine a current that flows between the measurement electrode and the developer element due to the voltage. Moreover, the developer station comprises a controller that is set up to induce the doser to adapt a developer layer that is to be applied onto the developer element and/or a developer layer that is to be adapted for the inking of the image substrate, depending on the voltage and/or on the current.

According to one aspect, a print group for a toner-based digital printer is described. The print group comprises the developer station described in this document.

Figure 1:
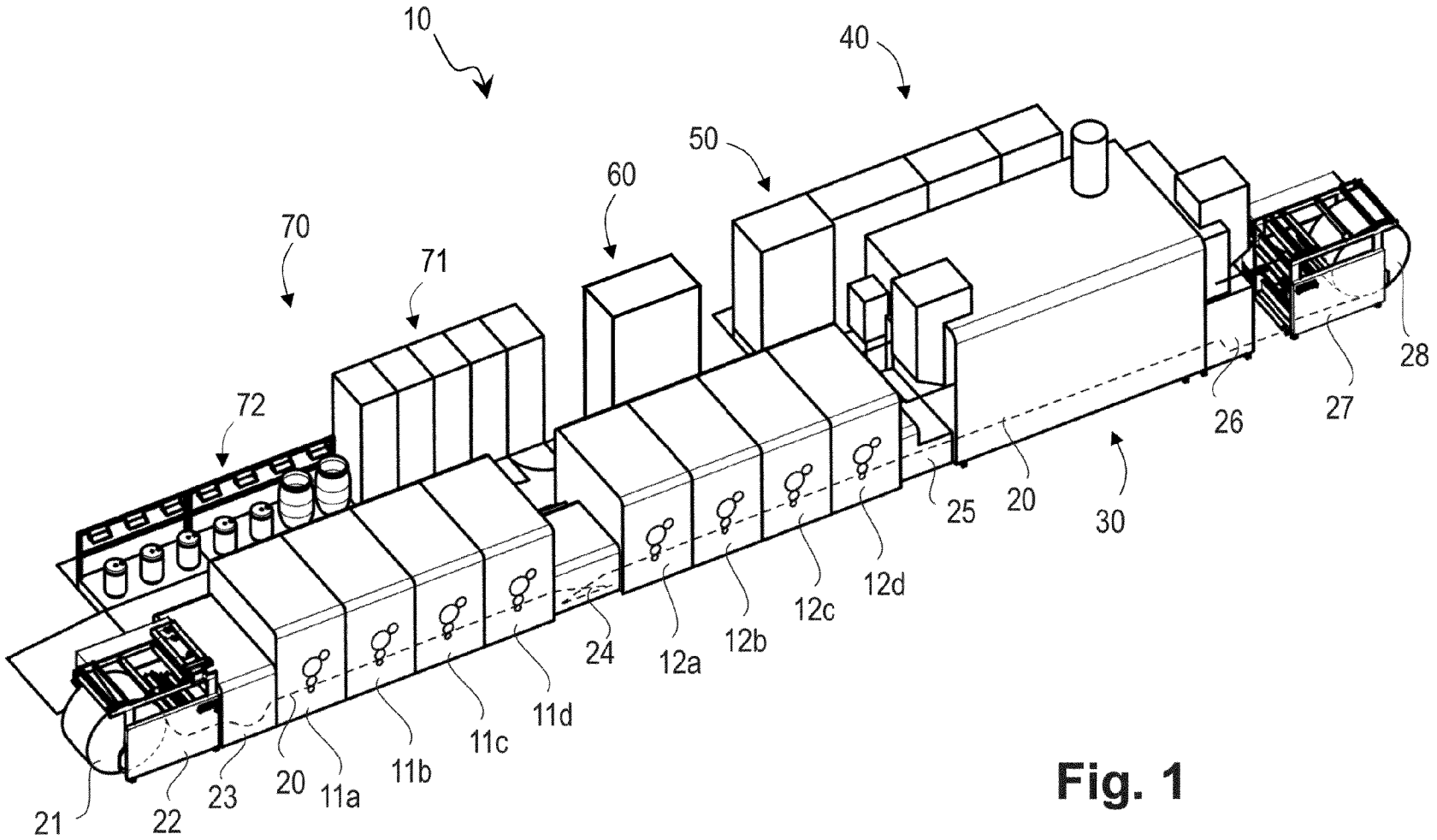
FIG. 1 illustrates an example digital printer.

FIG. 1 shows an example a digital printer 10 for printing to a recording medium 20. The digital printer 10 can include one or more print groups 11*a*-11*d* and 12*a*-12*d* that print a toner image (print image 20'; see FIG. 2) onto the recording medium 20. As shown, a web-shaped recording medium 20 (as a recording medium 20) is unrolled from a roll 21 with the aid of a take-off 22 and is supplied to the first print group 11*a*. The print image 20' is fixed on the recording medium 20 in a fixer 30. The recording medium 20 may subsequently be taken up on a roll 28 with the aid of a take-up 27. Such a configuration is also designated as a roll-to-roll printer. Details regarding the example digital printer 10 are described in detail in German Patent Application DE 10 2013 201 549 B3, Japanese Patent Application JP 2014/149526 A, and U.S. Patent Application 2014/0212632, each of which is incorporated herein by reference in its entirety.

Figure 2:
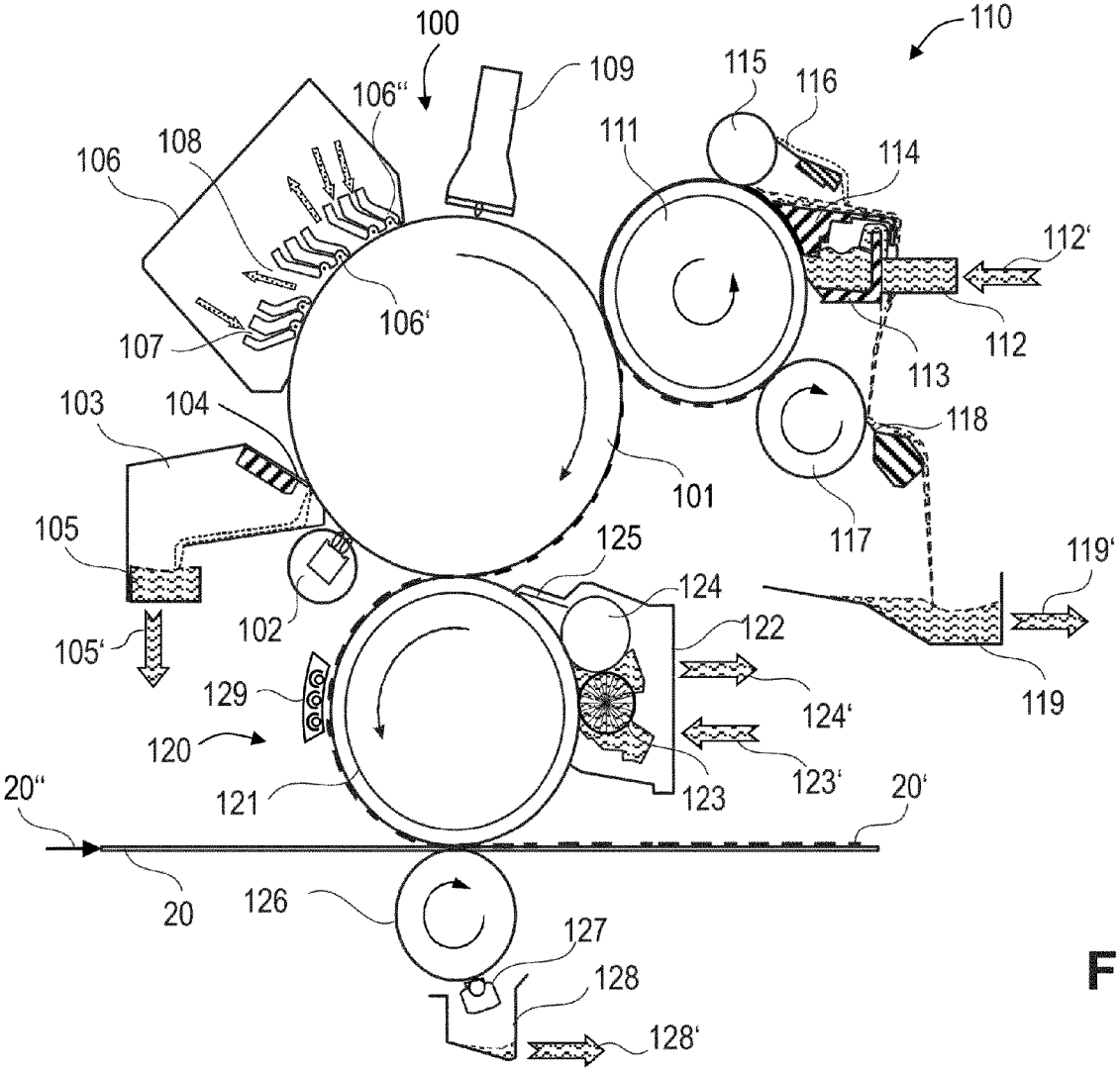
FIG. 2 illustrates a schematic design of a print group of the digital printer according to FIG. 1.

The principle design of a print group 11, 12 is depicted in FIG. 2. The print group depicted in FIG. 2 is based on the electrophotographic principle, given which a photoelectric image substrate (in particular a photoconductor 101) is inked with the aid of a liquid developer with charged toner particles, and the toner image that is created in such a manner is transferred to the recording medium 20. The print group 11, 12 is essentially comprised of an electrophotography station 100, a developer station 110 and a transfer station 120.

The core of the electrophotography station 100 is a photoelectric image substrate that has a photoelectric layer (what is known as a photoconductor) on its surface. The photoconductor here is designed as a roller (photoconductor roller 101) and has a hard surface. The photoconductor roller 101 rotates past the various elements to generate a print image 20' (rotation in the arrow direction).

The electrophotography station 100 comprises a character generator 109 that generates a latent image on the photoconductor 101. The latent image is inked with toner particles by the developer station 110 in order to generate an inked image (i.e. a toner image). For this, the developer station 110 has a rotating developer roller 111 that brings a layer of liquid developer onto the photoconductor 101.

The inked image rotates with the photoconductor roller 101 up to a first transfer point, at which the inked image (i.e. the toner image) is essentially completely transferred onto a transfer roller 121. The recording medium 20 travels in the transport direction 20" between the transfer roller 121 and a counter-pressure roller 126. The contact region (nip) represents a second transfer point in which the toner image is transferred onto the recording medium 20. The recording medium 20 may be made of paper, paperboard, cardboard, metal, plastic and/or other suitable and printable materials. Additional details with regard to the example of a print group 11, 12 that is depicted in FIG. 2 are described in German Patent Application DE 10 2013 201 549 B3, Japanese Patent Application JP 2014/149526 A, and U.S. Patent Application 2014/0212632.

In one or more exemplary embodiments, the quantity of toner that is applied onto a photoconductor roller 101 by a developer roller 111 is precisely adjusted in order to produce a uniform inking of the toner image onto the photoconductor roller 101 and a uniform inking of the print image 20' onto the recording medium 20.

In an exemplary embodiment, the provided quantity of toner is adjusted by measuring an inking and/or a color location optically with one or more optical sensors at a suitable point in the printing process. In an exemplary embodiment, the measurement of the inking and/or of the color location may already take place before the toner transfer to the recording medium 20 (for example at the developer roller 111) and/or after the toner transfer, and possibly after the fixing of the print image 20' (on the recording medium 20). In an exemplary embodiment, the provided quantity of toner may then be adapted (in particular regulated) on the basis of one or more optical measurement signals with regard to the inking and/or the color location.

The regulation of the toner quantity provided onto the developer roller 111 is advantageous with regard to a fast reaction to disruptions, since the regulation is already undertaken before the creation of a toner image. On the other hand, problems may result due to the determination of the inking by means of an optical sensor. The determination of the inking using an optical sensor typically assumes that the surface of the roller (of the developer roller 111, for example) on which the inking is measured by an optical measurement method has a high color contrast relative to the color of the toner. In particular, it may be necessary to use a roller with a white surface. Limitations with regard to the selection of materials that may be used for the roller result due to this condition. For example, these limitations may be disadvantageous to the effectiveness of the toner transfer from the developer roller 111 onto a photoconductor roller 101.

An additional problem may result (for example after long use) due to a film formation on the roller due to the toner that is used. A reference calibration for the determination of the inking may be hindered by such a film formation. Furthermore, the contrast difference between a toner-free surface of the roller and a surface of the roller with developer layer is reduced due to a film formation, which may lead to a decrease in the precision of inking measurements.

Additional problems in the optical measurement may result from the fact that the layer thickness of a developer layer, which layer thickness is to be adjusted, is within the saturation range of an optical sensor, such that a precise regulation of the layer thickness (and therefore of the provided quantity of toner) is not possible on the basis of a provided measurement signal. Moreover, a contamination of the optical sensor (by aerosols, for example) may lead to a falsification of the measurement values. Furthermore, the use of optical sensors typically requires complicated and cost-intensive electronics.

Figure 3:
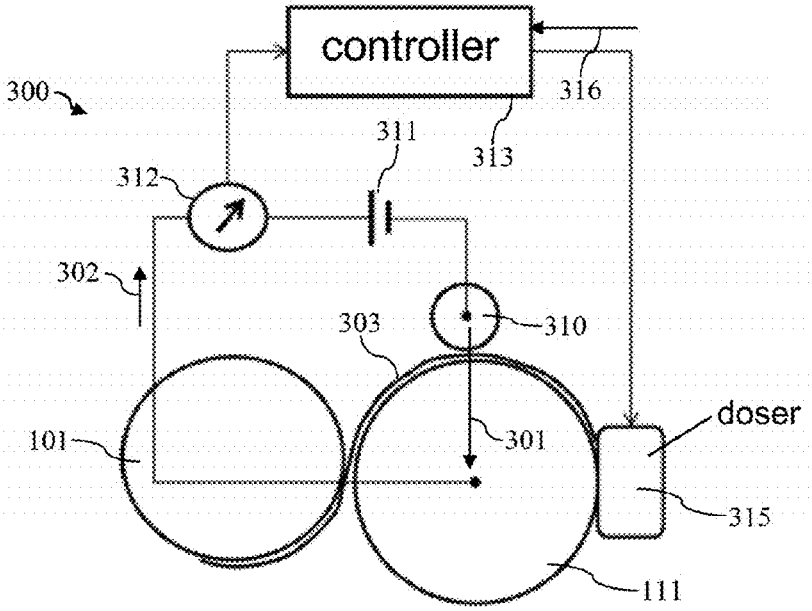
FIG. 3 illustrates a system configured to adjust the toner quantity in a developer station according to an exemplary embodiment of the present disclosure.

FIG. 3 shows a system 300 according to an exemplary embodiment. The system 300 is configured to enable the quantity of toner on a developer roller 111 (e.g., the layer thickness of a developer layer 303 on the developer roller 111 and/or the toner quantity in a developer layer 303 on the developer roller 111) to be measured electrically. The aforementioned problems of an optical measurement of the inking may be avoided via the system 300 depicted in FIG. 3.

In an exemplary embodiment, the system 300 includes a doser 315 (which, for example, includes the electrode segment 114 and, if applicable, the dosing roller 115 of the print group 11 from FIG. 2) that is configured to modify a property (for example a quantity of toner and/or a layer thickness) of the developer layer 303 on the developer roller 111. In this example, the doser 315 can adjust the dose (e.g., quantity) of the toner. In particular, the doser 315 can be configured to modify the quantity of developer applied onto the developer roller 111 and/or the quantity of toner applied onto the developer roller 111. For example, the doser 315 can be configured to change a toner application voltage between the doser 315 (in particular, the electrode segment 114) and the developer roller 111. The toner quantity in the developer layer 303 may be increased by increasing the toner application voltage, and vice versa. The toner application voltage is thus one example of a toner control variable, i.e. of a control variable with which the properties (in particular the toner quantity) of a developer layer 303 may be adapted.

In an exemplary embodiment, the thickness or size of a nip between the dosing roller 115 and the developer roller 111 can be used as a toner control variable, via which the layer thickness of the developer layer 303 may be adapted. In an exemplary embodiment, the thickness or size of the nip between the dosing roller 115 and the developer roller 111 is dependent on the rotation speed of the dosing roller 115 and/or on the contact pressure force between dosing roller 115 and developer roller 111. The size of the nip, or the rotation speed and/or the contact pressure force, are thus examples of toner control variables with which the properties (in particular the layer thickness) of a developer layer 303 may be adapted.

The developer layer 303 applied onto the developer roller 111 is brought to the photoconductor roller 101 by said developer roller 111 in order to develop a latent charge image on the photoconductor roller 101 with toner, and in order to thus generate a toner image on the photoconductor roller 101.

On the transport path between doser 315 and photoconductor roller 101, the developer layer 303 is directed past a measurement electrode 310 (for example past a measurement roller). In an exemplary embodiment, the measurement electrode 310 can be configured to apply an electrical field across the developer layer 303. In an exemplary embodiment, an electrical voltage 301 (i.e. a potential difference) may be applied between the measurement electrode 310 and the developer roller 111 (for example the rotation axle of the developer roller 111) in order to generate an electrical field transversally through developer layer 303. In an exemplary embodiment, the voltage 301 is produced by a voltage source 311 of the system 300. In an exemplary embodiment, the measurement electrode 310 includes its own voltage source, in particular, if the measurement electrode 310 is additionally used for a conditioning (for a smoothing, for example) of the developer layer 303. For example, in one embodiment, the dosing roller 115 may be used as a measurement electrode 310.

In an exemplary embodiment, a current 302 through the developer layer 303 is produced by the applied voltage 301. The strength of the current 302 may be measured by a current measurement device 312. The amperage of the current through the developer layer 303 may be considered as an indication of the transversal electrical resistance of the developer layer 303, of the thickness of the developer layer 303 and/or of the toner quantity in the developer layer 303. In particular, a relatively high current 302 may be an indication of a relatively low transversal electrical resistance, of a relatively thin developer layer 303 and/or of a relatively low toner quantity in the developer layer 303 (and vice versa).

In an exemplary embodiment, the system 300 includes a controller 313 configured to control the doser 315. The controller 313 can control the doser 315 based on the measured strength of the current 302. Furthermore, the doser 315 may be controlled depending on a target specification 316 (for example depending on the nominal value 434 described further below). In particular, the doser 315 may be induced by the controller 313 to adapt the thickness of the developer layer 303 and/or the toner quantity within the developer layer 303 depending on the measured amperage of the current 302, and possibly depending on a target specification 316. For example, the controller 313 can be configured to control the doser 315 to adapt the toner application voltage between electrode segment 114 and developer roller 111 and/or the contact pressure force between dosing roller 115 and developer roller 111. In an exemplary embodiment, the controller 313 includes processor circuitry configured to perform one or more functions of the controller 313, including, for example, controlling the doser 315.

In an exemplary embodiment, the system 300 is configured to apply an electrical field across the developer layer 303 via use off a conductive or partially conductive measurement roller 310 that is located in front of the inking nip (i.e., before the nip between developer roller 111 and photoconductor roller 101) such that a current 302 flows between the measurement roller 310 and the developer roller 111. In an exemplary embodiment, the current 302 is dependent on the toner quantity or on the developer layer 303 that is located between the measurement roller 310 and the developer roller 111 at a specific measurement point in time.

In an exemplary embodiment, a direct correlation between the amperage of the current 302 and the toner quantity offered by the developer roller 111 results. A regulation of the toner quantity applied by the doser 315 onto the developer roller 111 may thus be implemented via the provision of a "toner quantity vs. current flow" or "toner control variable vs. amperage" characteristic curve. The measured amperage of the current 302 (given constant voltage 301, for example) may thereby represent a controlled variable.

In an exemplary embodiment, the developer roller 111 has an elastomer coating. The electrical properties—in particular the electrical resistance—of the elastomer coating may vary with temperature. In an exemplary embodiment, the system 300 includes a temperature sensor (not shown) that configured to detect the temperature of the developer roller 111 (or the temperature of an environment of the developer roller 111). A characteristic curve which describes the correlation between current 302 and toner quantity, or between current 302 and toner control variable, may depend on the temperature. For example, a plurality of different characteristic lines for different temperatures may be provided. The controller 313 may then select a characteristic curve to be used depending on the measured temperature.

In an exemplary embodiment, the measurement electrode 310 is implemented via a component (roller, for example) already present in the print group 11. For example, the smoothing roller or the dosing roller 115 of the developer station 110 may be used as a measurement roller 310. For example, the toner application voltage between electrode segment 114 and developer roller 111 may then be used as a toner control variable.

In an exemplary embodiment, the already present component can be current-regulated (to a defined nominal current). In this case, a variation of the level of the voltage 301 that results from the current regulation may be used as an indicator of the transversal electrical resistance of the developer layer 303 and as an indicator of the toner quantity on the developer roller 111. For this purpose, the value of the voltage 301 may be determined, which can be used to produce a defined (constant) nominal current. The value of the voltage 301 may then indicate (via a characteristic curve) the layer thickness of a developer layer 303 or the toner quantity in the developer layer 303.

FIG. 4*a* shows an example of a curve 404 according to an exemplary embodiment. The curve 404 represents an optical measurement signal 403 of an optical sensor via which a degree of the inking of the developer roller 111 may be detected. The optical measurement signal 403 is depicted as a function of the toner application voltage 401 which is used by the doser 315 (in particular, by the electrode segment 114) in order to apply toner onto the developer roller 111. In an exemplary embodiment, the toner quantity on the developer roller 111 increases with increases toner application voltage 401 (and vice versa). In an exemplary embodiment, the toner application voltage 401 may thus be used by the controller 313 or by the doser 315 as a toner control variable in order to modify the toner quantity applied on the developer roller 111. From FIG. 4*a* it is clear that the curve 404 becomes saturated with increasing layer thickness or toner quantity (i.e. with increasing toner application voltage 401). From FIG. 4*a* it is thus clear that a precise adjustment of the layer thickness or toner quantity of the developer layer 303 is not possible using an optical sensor, in particular given relatively large layer thicknesses or toner quantities.

FIG. 4*c* shows a corresponding curve 405 of an optical measurement signal 403 according to an exemplary embodiment. The curve 405 corresponds to the inking of a recording medium 20 as a function of the toner application voltage 401.

FIG. 4*b* shows an example of a curve 411 of the amperage 402 of the current 302 through a developer layer 303 according to an exemplary embodiment. The curve 411 illustrates the amperage 402 of the current 302 through a developer layer 303 as a function of the toner application voltage 401. The toner application voltage 401 was thereby increased in stages. Furthermore, FIG. 4*b* shows a smoothed curve 412 (a mean value, for example) of the amperage 402. FIG. 4*b* shows an approximately linear correlation between the amperage 402 and the toner application voltage 401. The amperage 402 (in connection with the applied voltage 301) thus represents a precise indicator of the layer thickness of the developer layer 303 or of the toner quantity in the developer layer 303. FIG. 4*b* shows the curve 411 of the amperage 402 of the current 302 given a constant voltage 301. Analogously, a characteristic line for the curve of the value of the voltage 301 may be determined and provided given a current 302 that is regulated to a constant nominal current. The value of the voltage 301 may then be used as an indicator of the layer thickness of the developer layer 303 or of the toner quantity in the developer layer 303. In general, an indicator of the transversal electrical resistance of the developer layer 303 may be determined on the basis of the current 302 and on the basis of the voltage 301, wherein the transversal electrical resistance of the developer layer 303 indicates the layer thickness of the developer layer 303 and/or the toner quantity in the developer layer 303.

FIG. 4*d* shows an example of a control loop 420 configured to regulate the toner application voltage 401 according to an exemplary embodiment. The regulation of the toner application voltage 401 can depend on the amperage 402 of the current 302 through the developer layer 303. Analogously, a regulation based on the voltage 301 may be provided. In an exemplary embodiment, a nominal value 434 for the toner application voltage 401 is provided as a command variable, via which a desired layer thickness of the developer layer 303 or a desired toner quantity in the developer layer 303 is produced. In the example depicted in FIG. 4*d*, the real amperage 432 of the current 302 is the controlled variable. The real amperage 432 may be converted (e.g., using the characteristic curve 411 and/or the mean characteristic curve 412, which may depend on the temperature 436 of the developer roller 111) into a real value 433 of the toner application voltage 401.

In an exemplary embodiment, the real value 433 of the toner application voltage 401 is subtracted from the nominal value 434 of the toner application voltage 401 in order to determine a control error 435. Using a controller 402 (for example a controller with P (proportional), I (integral) and/or D (differential) configurations), an adapted value 431 of the toner application voltage 401 can be determined as a control variable. In an exemplary embodiment, the adapted value 431 of the toner application voltage 401 may be adjusted at the doser 315 in order to adapt the properties (in particular the toner quantity) of the developer layer 303. In an exemplary embodiment, the present amperage 432 of the current 432 is produced via the actual control path 422 (i.e. by the actual path between doser 315, measurement roller 310 and developer roller 111), which present amperage 432 may then be used again for the further adaptation of the toner application voltage 401.

A developer station 110 for a print group 11 of a toner-based digital printer 10—for example of an electrographic (in particular electrophotographic) or magnetographic digital printer—will now be described. In an exemplary embodiment, the developer station 110 includes a developer element 111 that is set up to ink an image substrate 101 (for example a photoconductor, in the event of an electrographic digital printer) of the print group 11 with toner particles from the developer layer 303. In particular, the developer element 111 may be set up to carry a developer layer 303 to the image substrate 101 for the inking of said image substrate 101 and for the creation of a toner image. For example, the developer element 111 may include a developer roller and the image substrate 101 may include an image substrate roller. In an exemplary embodiment, via rotation of the developer roller, the developer layer 303 may be carried to the image substrate roller and be transferred at least partially to the image substrate roller.

In an exemplary embodiment, the developer layer 303 includes toner particles. Furthermore, the developer layer 303 may include a carrier fluid for the toner particles. The developer layer 303 carried to the image substrate 101 may include specific properties which influence the inking of the image substrate 101. In an exemplary embodiment, the developer layer 303 includes a specific toner quantity (per area unit of the developer layer 303), where a degree of the inking of the image substrate 101 typically increases by raising the toner quantity (and vice versa).

In an exemplary embodiment, the developer station 110 further includes a doser 315 that is configured to apply a developer layer 303 onto the developer element 111 and/or to adapt the developer layer 303 for the inking of the image substrate 101. In particular, the doser 315 is configured to adapt the developer layer 303 based on a toner control variable 401, such as the toner application voltage 401. In an exemplary embodiment, one or more properties of the developer layer 303 (for example a thickness and/or a density and/or a toner quantity) may thereby be adapted to the developer layer 303. In an exemplary embodiment, the doser 315 includes an electrode segment 114 and/or a dosing roller 115 for the application of the developer layer 303. In particular, developer may be applied onto the developer element 111 via the electrode segment 114. The layer thickness of the developer layer 303 may subsequently be adapted via the dosing roller 115. The toner quantity within the developer layer 303 may be adapted via the toner application voltage 401 between the electrode segment 114 and the developer element 111.

In an exemplary embodiment, the toner quantity within the developer layer 303 may be increased by increasing the toner application voltage 401 (and vice versa). The layer thickness of the developer layer 303 may be adapted via the contact pressure force between dosing roller 115 and developer element 111. In particular, the layer thickness may be reduced by increasing the contact pressure force (and vice versa).

In an exemplary embodiment, the doser 315 includes the electrode segment 114 that is configured to apply the developer layer 303 onto the developer element 111. In this example, the toner application voltage 401 between the electrode segment 114 and the developer element 111, via which the toner quantity in the developer layer 303 may be adapted, serves as a toner control variable.

In an exemplary embodiment, the developer station 110 includes a measurement electrode 310 that is arranged such that a developer layer 303 that has already been applied by the doser 315 onto the developer element 111 and/or that has already been adapted by the doser 315 is located between the measurement electrode 310 and the developer element 111. In other words, the measurement electrode 310 may be arranged such that a developer layer 303 that has already been applied by the doser 315 onto the developer element 111, and/or that has already been adapted by the doser 315, may be directed through a gap (a roller nip, for example) between the measurement electrode 310 and the developer element 111. In other words again, given use of a developer roller 111 the measurement electrode 310 may be arranged after the doser 315 in the rotation direction of the developer roller 111 (and before a point at which the developer layer 303 is used to develop a toner image). In an exemplary embodiment, the measurement electrode 310 includes an electrically conductive measurement roller, for example.

In an exemplary embodiment, the developer station 110 includes a voltage source 311 that is configured to apply a voltage 301 (i.e. a potential difference) between the measurement electrode 310 and the developer element 111. Moreover, the developer station 110 can include a current measurement device 312 that is configured to determine (for example, to detect) a current 302 that flows between the measurement electrode 310 and the developer element 111 due to the applied voltage 301.

In an exemplary embodiment, the developer station 110 includes a controller 313 that is configured to induce/control the closer 315 to adapt the developer layer 303 to be applied onto the developer element 111, and/or a developer layer 303 that is to be adapted for the inking of the image substrate 101, depending on the current 302. In an exemplary embodiment, the developer layer 303 may be adapted depending on the voltage 301 and depending on the current 302 (for example depending on a relative ratio between voltage 301 and current 302). The developer layer 303 may thus be precisely adapted by the developer station 110 in order to produce a homogeneous inking of the image substrate 101.

In an exemplary embodiment, the measurement electrode 310 includes an element configured to smooth the developer layer 303 on the developer element 111. For example, a measurement roller can include a smoothing roller that is already used for the smoothing of the developer layer 303 on the developer element 111. The measurement electrode 310 may thus be provided in a cost-effective and space-efficient manner. For example, the smoothing roller may include the dosing roller 115 or correspond to the dosing roller 115. The current between dosing roller 115 and developer element 111 may then be measured. Furthermore, the toner application voltage 401 between the electrode segment 114 and the developer element 111 may be adapted depending on the current 302 in order to adapt (for example regulate) the toner quantity in the developer layer 303.

FIG. 5 shows a workflow diagram of a method 500 for the adaptation of a developer layer 303 on the developer element 111 according to an exemplary embodiment. The developer element 111 is set up to ink an image substrate 101 of a toner-based digital printer 10 with toner particles from the developer layer 303.

In an exemplary embodiment, the method 500 includes the application 501 of a voltage 301 between a measurement electrode 310 and the developer element 111. The measurement electrode 310 is thereby arranged such that a developer layer 303 that has already been applied onto the developer layer 111 and/or that has already been adapted for the inking of the image substrate 101 is located between the measurement electrode 310 and the developer layer 111 (for example in a roller nip between a measurement roller and a developer roller). In other words, the measurement electrode 310 may be arranged after a doser 315 via which the developer layer 303 is adapted for the inking of the image substrate 101.

In an exemplary embodiment, the method 500 further includes the determination (detection, for example) 502 of a current 302 that flows between the measurement electrode 310 and the developer element 111 due to the voltage 301. For example, the amperage 402 of the current 302 may be determined.

In an exemplary embodiment, the method 500 includes the adaptation 503 of a developer layer 303 to be applied onto the developer element 111 and/or to be adapted for the inking of the image substrate 101, depending on the voltage 301 and/or depending on the current 302. For example, the developer layer 303 can be adapted depending on the value of the applied voltage 301 and/or on the determined amperage 402 of the current 302. In particular, the quantity of toner in the developer layer 303 and/or the thickness of the developer layer 303 may thereby be adapted.

In an exemplary embodiment, via the consideration of the current 302 and/or of the voltage 301, the method 500 enables a precise adjustment of the quantity of toner applied onto the developer element 111 or of the thickness of the developer layer 303 applied onto the developer element 111. In particular, a precise adjustment of the properties of the developer layer 303 may take place even given relatively high toner quantities or given a relatively thick developer layer 303. The precise adjustment of the toner quantity or of the developer layer thickness in turn enables an inking of print images 20' that is consistent over time.

In an exemplary embodiment, the developer layer 303 may be adapted via a toner control variable 401 (for example via a toner application voltage between electrode segment 114 and developer element 111). In an exemplary embodiment, the method 500 may additionally include the determination of a characteristic curve 411, 412 which indicates a correlation between the voltage 301 and/or the current 302 on the one hand and the toner control variable 401 on the other hand. In an exemplary embodiment, the characteristic curve 411, 412 may be based on a plurality of test measurements with different values of the toner control variable 401 and/or with different values of the current 302 and/or of the voltage 301. Different characteristic curves 411, 412 may thereby be determined for different developer types (in particular for different color toners, for example of the colors C, M Y, K, O, V, and/or G). In an exemplary embodiment, the adaptation 503 of the developer layer 303 that is to be applied onto the developer element 111 may include the adaptation of the toner control variable 401 depending on the characteristic curve 411, 412, wherein the characteristic curve 411, 412 typically depends on the developer types of the developer layer 303. The precision of the adjustment of the toner quantity or of the thickness of the developer layer 303 may thus be further increased.

In an exemplary embodiment, the adaptation (in particular the regulation) of a property of the developer layer 303 (for example of the toner quantity in the developer layer 303) may take place using a characteristic curve 411, 412. The developer layer 303 may thus be adapted (in particular regulated) depending on the voltage 301 and/or depending on the current 302, as well as depending on the characteristic curve 411, 412. In an exemplary embodiment, the current 302 (i.e. the measured amperage 402) is compared with the characteristic curve 411, 412 in order to adapt the developer layer 303. For example, on the basis of the measured amperage 402 and the characteristic curve 411, 412 it may be determined whether the developer layer 303 that is used for the inking of the image substrate 101 comprises the desired toner quantity. If this is not the case, the toner control variable 401 (i.e. in particular the toner application voltage) may thus be adapted in order to adapt the toner quantity of the developer layer 303. A consistent inking of the image substrate 101 may thus be produced.

In exemplary embodiments, the characteristic curve 411, 412 can indicate what concrete characteristic of the property of the developer layer 303 (for example what concrete toner quantity) corresponds to a specific measured amperage 402 of the current 302 and/or to a specific value of the voltage 301. Alternatively or additionally, the characteristic curve 411, 412 may indicate what value of the toner control variable 401 (for example of the toner application voltage) corresponds to a specific measured amperage 402 of the current 302 and/or to a specific value of the voltage 301. For example, the characteristic curve 411, 412 may be determined in that the amperages 402 and/or voltage values that result for specific values of the toner control variable 401 (and therefore for specific properties of the developer layer 303) are measured within the scope of test measurements.

In an exemplary embodiment, the amperage 402 and/or voltage value that results if no developer layer 303 is located on the developer element 111 can be determined using a reference measurement. A reference amperage (for a specific nominal voltage value) or a reference voltage value (for a specific nominal current value) may thus be determined. In an exemplary embodiment, the adaptation of the developer layer 303 may also take place depending on the reference amperage and/or on the reference voltage value. In particular, a characteristic curve 411, 412 may be adapted under consideration of the reference amperage and/or of the reference voltage value. For example, the characteristic curve 411, 412 may be shifted or "offset" depending on the reference amperage and/or the reference voltage value. In an exemplary embodiment, a measurement offset of the characteristic curve 411, 412 may thus be compensated, and the precision of the adjustment of the toner quantity or of the thickness of the developer layer 303 may be further increased.

In an exemplary embodiment, the method 500 may additionally include the determination of a temperature 436 of the developer element 111. The toner control variable 401 may then (also) be adapted depending on the temperature 436 of the developer element 111. For example, depending on the temperature 436 the characteristic curve 411, 412 may be adapted or a different characteristic curve 411, 412 may be selected from a plurality of temperature-dependent characteristic curves 411, 412. In an exemplary embodiment, the precision of the adjustment of the toner quantity or of the thickness of the developer layer 303 may be further increased by taking the temperature 436 into account.

In an exemplary embodiment, the toner control variable 401 may be regulated to a nominal value 434 of the toner control variable 401 depending on the characteristic curve 411, 412 and depending on the voltage 301 and/or on the current 302. In an exemplary embodiment, a control loop 420 with a controller 421 may be provided for this purpose. The precision of the adjustment of the toner quantity or of the thickness of the developer layer 303 may be further increased via the regulation of the toner control variable 401.

In an exemplary embodiment, the method may include the determination, on the basis of, for example, the voltage 301 and/or on the basis of the current 302, of an indicator of a transversal electrical resistance of the developer layer 111 that has already been applied onto the developer element 111 and/or that has already been adapted for the inking of the image substrate 101. In an exemplary embodiment, an indicator of the transversal electrical resistance of the developer layer 111 may be determined on the basis of a ratio of the determined amperage 402 of the current 302 and the value of the set voltage 301. The developer layer 303 that is to be applied onto the developer element 111 and/or that is to be adapted may then be adapted depending on the indicator of the transversal electrical resistance.

The method described in the exemplary embodiments and the developer station 110 described in the exemplary embodiments enable a precise adjustment of the provided toner quantity without the use of an optical sensor. The disadvantages described which result from the use of an optical sensor can be avoid. Moreover, a precise adjustment in a wide range of layer thicknesses or toner quantities is enabled. Furthermore, the method 500 and the developer station 110 may be implemented more cost-effectively, in particular, if a component (for example a smoothing roller) of a print group 11 that is already used otherwise is used as a measurement electrode 310.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, processor circuitry can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 digital printer
11, 11*a*-11*d* print group (front side)
12, 12*a*-12*d* print group (back side)
20 recording medium
20' print image (toner)
20" transport direction of the recording medium
21 roll (input)
22 take-off
23 conditioning group
24 turner
25 register
26 drawing group
27 take-up
28 roll (output)
30 fixer
40 climate control module
50 power supply
60 controller
70 fluid management
71 fluid controller
72 reservoir
100 electrophotography station
101 image substrate (photoconductor, photoconductor roller)
102 erasure light
103 cleaning device (photoconductor)
104 blade (photoconductor)
105 collection container (photoconductor)
106 charging device (corotron)
106' wire
106" shield
107 supply air channel (aeration)
108 exhaust air channel (ventilation)
109 character generator
110 developer station
111 developer element (developer roller)
112 storage chamber
112' fluid supply
113 pre-chamber
114 electrode segment
115 dosing roller (developer roller)
116 blade (dosing roller)
117 cleaning roller (developer roller)
118 blade (cleaning roller of the developer roller)
119 collection container (liquid developer)
119' fluid discharge
120 transfer station
121 transfer roller
122 cleaning unit (wet chamber)
123 cleaning brush (wet chamber)
123' cleaning fluid discharge
124 cleaning roller (wet chamber)
124' cleaning fluid discharge
125 blade
126 counter-pressure roller
127 cleaning unit (counter-pressure roller)
128 collection container (counter-pressure roller)
128' fluid discharge
129 charging unit (corotron at transfer roller)
300 system for adaptation of the toner quantity
301 voltage

302 current
303 developer layer
310 measurement electrode (measurement roller)
311 power supply
312 current measurement device
313 controller
315 doser
316 target specification
401 toner application voltage
402 amperage (mA)
403 optical measurement signal
404, 405 curve of the optical measurement signal
411 curve of the amperage
412 smoothed curve of the amperage
420 control loop
421 controller
422 control path
431 adapted value of the toner application voltage
432 real amperage
433 real value of the toner application voltage
434 nominal value of the toner application voltage
345 control error
436 temperature
500 method to adjust the toner quantity
501, 502, 503 method steps

What is claimed is:

1. A method to adapt a layer of developer on a developer element operable to ink an image substrate of a toner-based digital printer with toner particles from the developer layer, the method comprising:

applying a first voltage between an electrode segment of a doser and the developer element to apply, using the electrode segment of the doser, the developer to form a developer layer on the developer element;

applying a second voltage between a measurement electrode and the developer element, wherein the measurement electrode is arranged after the electrode segment in a rotation direction of the developer element such that the developer layer applied to the developer element is located between the measurement electrode and the developer element;

determining a current that flows between the measurement electrode and the developer element due to the second voltage;

determining a toner control variable based on the determined current and the second voltage;

adapting, by the doser, a thickness of the developer forming a subsequent developer layer to be applied by the electrode segment at the doser based on the toner control variable.

2. The method according to claim 1, further comprising:

determining a characteristic curve which indicates a correlation between the toner control variable and at least one of the voltage and the current, wherein at least one of the adapting the subsequent developer layer to be applied by the electrode segment at the doser and the determining the toner control variable is based on the characteristic curve.

3. The method according to claim 2, further comprising:

determining a temperature of the developer element, wherein the toner control variable is adapted based on the temperature of the developer element.

4. The method according to claim 3, wherein at least one of:

the characteristic curve is based on a plurality of test measurements with different values of the toner control variable; and the characteristic curve depends on a type of developer that is located in the developer layer.

5. The method according to claim 3, wherein the toner control variable is regulated to a nominal value of the toner control variable based on the characteristic curve, the voltage, and the current.

6. The method according to claim 2, wherein at least one of:

the characteristic curve is based on a plurality of test measurements with different values of the toner control variable; and the characteristic curve depends on a type of developer that is located in the developer layer.

7. The method according to claim 6, wherein the toner control variable is regulated to a nominal value of the toner control variable based on the characteristic curve, the voltage, and the current.

8. The method according to claim 2, wherein the toner control variable is regulated to a nominal value of the toner control variable based on the characteristic curve, the voltage, and the current.

9. The method according to claim 1, further comprising:

determining an indicator of a transversal electrical resistance of the developer layer based on the voltage and the current, wherein the subsequent developer layer to be applied by the electrode segment at the doser is adapted based on the indicator of the transversal electrical resistance.

10. The method according to claim 1, wherein the measurement electrode is separate from the doser.

11. The method according to claim 1, further comprising:

determining a temperature of the developer element; and adapting the toner control variable based on the temperature of the developer element.

12. A developer station for a print group of a toner-based digital printer, the developer station comprising:

a developer element that is configured to ink an image substrate of the print group with toner particles from a developer layer located on the developer element;

a doser including an electrode segment configured to apply a first voltage between the electrode segment and the developer element to apply the developer layer onto the developer element;

a measurement electrode that is arranged after the segment electrode in a rotation direction of the developer element such that the developer layer applied to the developer element is located on the developer element between the measurement electrode and the developer element;

a power supply that is configured to apply a second voltage between the measurement electrode and the developer element;

a current measurement device that is configured to determine a current that flows between the measurement electrode and the developer element due to the second voltage; and a controller that is configured to:

determine a toner control variable based on the determined current and the second voltage; and control the doser to adapt a thickness of a subsequent developer layer to be applied onto the developer element by the doser based on the toner control variable.

13. The developer station according to claim 12, wherein at least one of:

the developer element includes a developer roller;

the image substrate includes an image substrate roller; and the measurement electrode includes an electrically conductive measurement roller.

14. The developer station according to claim 13, wherein the measurement electrode includes an element configured to smooth the developer layer on the developer element.

15. The developer station according to claim 12, wherein the measurement electrode includes an element configured to smooth the developer layer on the developer element.

16. The developer station according to claim 12, wherein the controller is further configured to:

determine a temperature of the developer element; and adapt the toner control variable based on the temperature of the developer element.

17. A method to adapt a layer of developer on a developer element of a printer, the printer including a measurement electrode adjacent to the developer element, the method comprising:

applying, using a doser, developer on the developer element at a first position to create a developer layer on the developer element;

applying a voltage between the measurement electrode and the developer element, the measurement electrode being arranged at a second position, wherein the developer travels from the first position to the second position based on a movement of the developer element;

determining a current that flows between the measurement electrode and the developer element due to the voltage; and adjusting the application of the developer by the doser based on the voltage and the current to adjust a quantity of toner within the developer forming a subsequent developer layer to be applied to the developer element by the doser.

18. The method according to claim 17, further comprising: determining a temperature of the developer element, wherein the toner control variable is adapted based on the temperature of the developer element.

* * * * *